US006116217A

United States Patent [19]

Klopfer

[11] Patent Number: 6,116,217

[45] Date of Patent: Sep. 12, 2000

[54] FULL AUTHORITY RAIL PRESSURE-REDUCTION VALVE

[75] Inventor: Kenneth H. Klopfer, East Hartland, Conn.

[73] Assignee: Stanadyne Automotive Corp., Windsor, Conn.

[21] Appl. No.: 09/163,261

[22] Filed: Sep. 29, 1998

[51] Int. Cl.[7] ..... F02M 41/00

[52] U.S. Cl. ..... 123/467; 123/514; 137/115.06

[58] Field of Search ..... 123/496, 506, 123/467, 456, 514; 137/115.06, 115.16

[56] References Cited

U.S. PATENT DOCUMENTS

| | | | |
|---|---|---|---|
| 2,247,421 | 7/1941 | Tabb | 123/467 |
| 3,759,235 | 9/1973 | Vuaille | 123/467 |
| 3,882,678 | 5/1975 | Fassbender | 137/115.06 |
| 4,044,746 | 8/1977 | Kaye | 123/514 |
| 4,941,502 | 7/1990 | Loos | 137/115.06 |
| 5,311,905 | 5/1994 | Desantis | 137/115.06 |
| 5,390,692 | 2/1995 | Jones | 123/467 |
| 5,477,825 | 12/1995 | Hassinger | 123/467 |
| 5,669,356 | 9/1997 | Wall | 123/467 |
| 5,860,797 | 1/1999 | Fujimura | 137/115.06 |

*Primary Examiner*—Carl S. Miller
*Attorney, Agent, or Firm*—Alix, Yale & Ristas, LLP

[57] ABSTRACT

A hydro-mechanical device and methods therefor, for receiving fuel from a variable displacement fuel pump of a fuel-supply system and delivering the fuel to a common rail of the fuel-supply system, regulates the fuel-pressure in the fuel-supply system, at least in part, based on the output of the fuel pump such that optimal engine performance can be maintained under varying operating conditions.

24 Claims, 2 Drawing Sheets

FULL AUTHORITY RAIL PRESSURE-REDUCTION VALVE

BACKGROUND OF THE INVENTION (1) Field of the Invention

The present invention generally relates to fuel injection systems for internal combustion engines. More particularly, the invention relates to improved methods and devices for supplying high-pressure diesel fuel for injection into an internal combustion engine. Accordingly, the general objects of the present invention are to provide novel and improved methods and devices of such character.

(2) Description of the Related Art

Fuel-supply systems for internal combustion engines are well known in the art. Recent developments in the fuel injection art have focused on supplying fuel to fuel injectors from a common fuel-supply rail which can reach very high-pressure levels. For example, pressure levels in such systems can vary from 2,000 psi up to about 29,000 psi (i.e., about 138 bars to about 2,000 bars). A fuel injection system of this type is described in co-pending U.S. patent application 09/065,895, filed on Apr. 23, 1998, the contents of which are hereby incorporated by reference. One characteristic of fuel-supply systems of the type shown and described in the incorporated reference is that optimal performance requires that the fuel-pressure from the common rail be varied with engine performance conditions. Thus, while the fuel-pressure in the common rail is generally maintained within a predetermined range, the fuel-pressure will optimally deviate with rapid changes in the engine operating conditions. Fuel-pressure rates of change on the order of 300 bars over a 0.2 second time interval are typically desired during engine operation. Accordingly, an optimal common rail fuel-supply system should be capable of both increasing and decreasing fuel-pressure at least fast enough to meet this pressure change criterion.

While a number of fuel-supply systems currently in use can meet the above-noted pressure change criterion, they all suffer from one deficiency or another. One such fuel system uses a constant displacement high-pressure fuel pump and regulates common rail fuel-pressure by utilizing an electronically controlled actuator to spill excess fuel as necessary. In this system, an electronically controlled spill valve becomes more restrictive when increased fuel-pressure is needed in the common rail. Under the influence of the electronic control unit, the system dumps excess fuel when reduced fuel-pressure in the common rail is desired. Significantly, the system suffers from high parasitic losses at light and mid loads.

In other fuel systems of the type noted above, a variable displacement pump is utilized in conjunction with an electronically controlled spill valve to improve fuel-supply efficiency. However, these systems rely upon expensive electronically controlled dump valves which are used to reduce fuel-pressure in the common rail. Moreover, two levels of electronic control, one for the pump and one for the spill valve, are necessary to efficiently operate the system.

Yet another fuel-supply system of the type noted above utilizes a variable displacement pump and leakage from at least one fuel injector to reduce fuel-pressure in the common rail as necessary. In such a system it is only necessary to provide electronic control over the variable displacement pump. However, the pump of this system is typically unable to obtain fuel-pressure decreases on the order of 300 bars over a 0.2 second time interval at light loads.

Accordingly, there is a need in the art for an inexpensive fuel-pressure-reduction device which permits fuel systems of the nature discussed above to achieve the desired fuel-pressure-reduction rates with a minimum of electronic control and without any complex components. Such a fuel-pressure-reduction device should be both inexpensive and permit efficient engine operation at low, medium and high loads.

SUMMARY OF THE INVENTION

It is, accordingly, an object of the present invention to provide an inexpensive hydro-mechanical device which improves fuel-pressure-reduction rates in common rail fuel-supply systems and which does not rely on auxiliary electronic actuators for operation.

It is a further objection of the present invention to provide methods of improving fuel-pressure-reduction rates in a fuel-supply system of the general type noted above, such methods relying on high pressure fuel pump delivery volumes to regulate fuel-pressure within the system.

It is still another object of the present invention to provide a fuel-supply system of the type noted above which can achieve an optimal combination of simplicity, reliability, efficiency and economy.

These and other objects and advantages of the present invention are provided in one embodiment by a hydro-mechanical device for receiving fuel from a high-pressure fuel pump of a fuel-supply system and delivering the fuel to a common rail of the fuel-supply system. The device passively regulates the fuel-pressure in the fuel-supply system, at least in part, by initiating spill of over pressure fuel based on the variable output of the high-pressure fuel pump.

The device is a pressure-reduction-valve assembly which includes a housing, a movable shuttle valve and biasing means for resiliently and constantly biasing the shuttle valve within the housing. The housing includes an interior cavity having first and second opposing ends and a spill port for returning spilled fuel to an excess fuel receptacle. In one preferred embodiment, the housing is affixed to the fuel pump such that the first end of the cavity is capable of receiving pressurized fuel directly from the output end of the fuel pump. The housing, in use, is also affixed to the common rail such that the second end of the cavity is in fluid communication with the common rail. A first valve, which is preferably a check valve, can be disposed within the housing cavity for limiting fuel-flow between the fuel pump and the cavity. The shuttle valve is preferably sealingly disposed within the housing cavity intermediate the first and second ends thereof and regulates fuel-flow through the pressure-reduction valve assembly. This shuttle valve is capable of movement between a fuel-transfer position, wherein the common rail is capable of receiving fuel from the fuel pump, and a fuel-spill position, wherein the common rail is capable of delivering fuel to the spill port. The biasing means resiliently and constantly biases the shuttle valve toward the fuel-spill position.

When used in its intended fashion, the inventive fuel-pressure-reduction valve assembly passively regulates the fuel within the fuel-supply system at least in part based upon the output of the variable displacement high-pressure fuel pump with which it is utilized. If this fuel pump is an intermittent pump, it intermittently supplies pressurized charges of fuel to the pressure-reduction valve assembly for delivery to the common rail as desired. In particular, the pump alternately (1) transfers fuel from the pump to the pressure-reduction valve assembly for an unpredetermined period of time, and (2) ceases the transfer of fuel from the pump into the pressure-reduction valve assembly for an unpredetermined period of time. The net result of this activity is to create a variable bias-pressure within the pressure-reduction valve assembly which counteracts the constant bias force provided by the biasing means and, sometimes, by the fuel-pressure in the common rail. It should be noted, however, that the inventive pressure-reduction valve assembly can also be utilized with a constant flow variable displacement pump, in which case the first valve would be unnecessary and fuel flow would be continuous.

In a preferred embodiment of the present invention, a small portion of the fuel transferred from the pump into the pressure-reduction valve assembly is selectively spilled therefrom to gradually reduce the bias-pressure within the pressure-reduction valve assembly. The pressure-reduction valve assembly transfers fuel to the common rail when the variable bias-pressure force within the pressure-reduction valve assembly exceeds the combined force of the biasing means and the fuel-pressure within the common rail. Conversely, fuel is transferred from the common rail into the pressure-reduction valve assembly when the combined force of the biasing means and the fuel-pressure within the common rail exceeds the variable bias-pressure force within the pressure-reduction valve assembly. Once this occurs, the fuel entering the pressure-reduction valve assembly from the common rail is spilled into an excess fuel receptacle thereby reducing the fuel pressure in the common rail. When the desired fuel pressure in the common rail is reached, fuel is delivered from the pump to the fuel-pressure reduction valve which reestablishes the bias pressure and terminates spillage from the common rail. The process noted above repeats as necessary to regulate the fuel-pressure within the common rail to achieve optimal engine performance and efficiency.

BRIEF DESCRIPTION OF THE DRAWINGS

The preferred embodiment of the present invention will be described below with reference to the accompanying drawings wherein like numerals represent like structures and wherein.

DESCRIPTION OF THE PREFERRED EMBODIMENT

Figure 1:
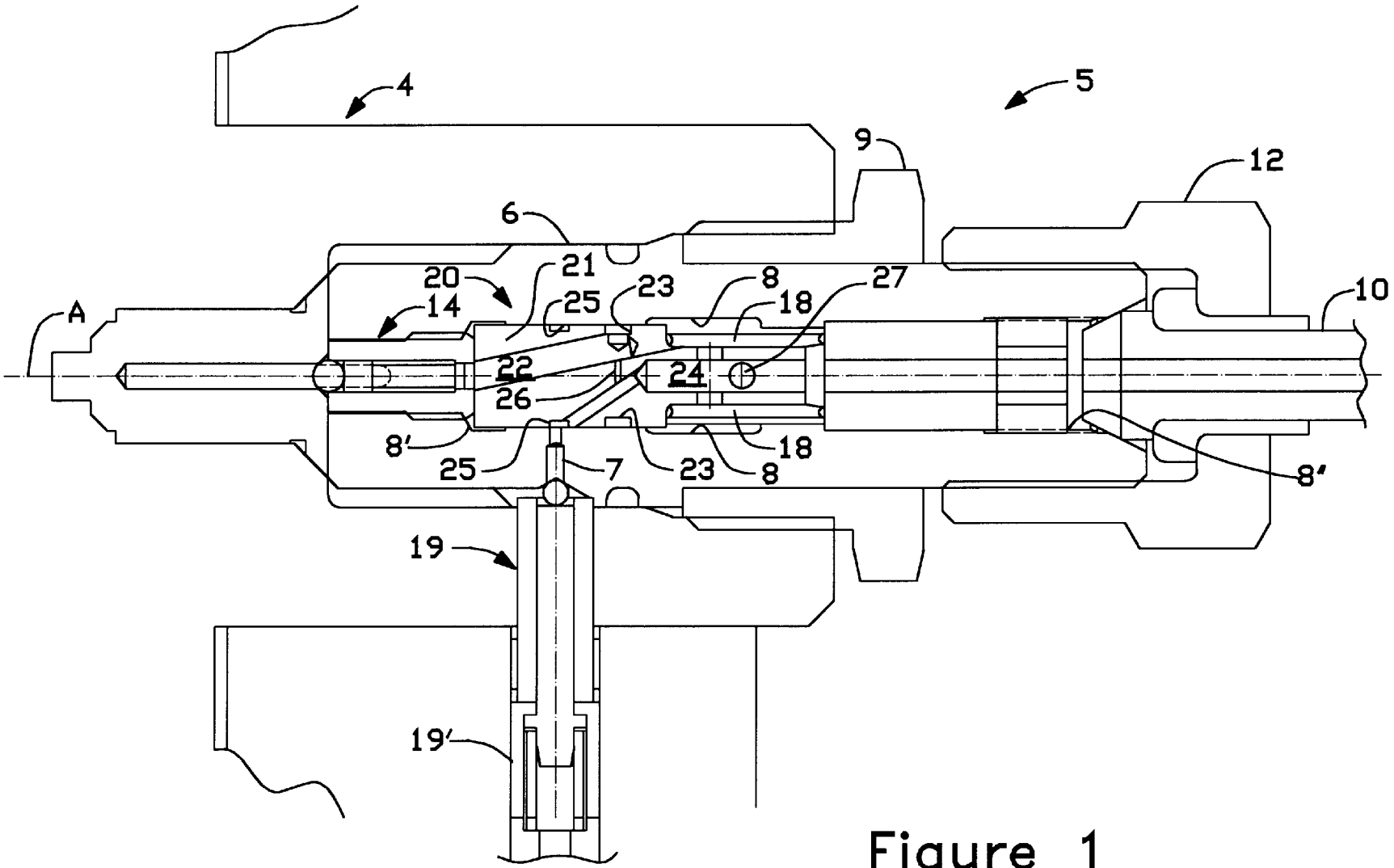
FIG. 1 is a cross-sectional view of the inventive pressure-reduction valve assembly in combination with a fuel pump and a fuel utilization device, the inventive valve assembly being shown in a fuel-spill position.

As shown in FIG. 1, an inventive pressure-reduction valve assembly 5 is preferably installed in a variable displacement high-pressure pump 4 using a first threaded fitting 9. Additionally, a fuel utilization device, in this case the common rail 10 of the common rail fuel-supply system, is affixed to valve assembly 5 using a second threaded fitting 12. Valve assembly 5 includes a housing 6 which is connected to fuel pump 4 and common rail 10 such that an interior cavity 8 thereof is, at least, capable of being in fluid communication with fuel pump 4 and common rail 10. As shown, housing 6 defines an interior cavity 8 with opposing first and second ends 8' and 8", respectively. Housing 6 further defines a spill port 7 laterally extending from cavity 8. Shuttle valve 20 is disposed within cavity 8 intermediate first and second ends 8' and 8". As shown, shuttle body 21 is preferably generally cylindrical and is disposed for linear reciprocal movement within cavity 8 along a longitudinal axis A.

A first valve 14, is preferably disposed within cavity 8 in alignment with longitudinal axis A. The valve 14 is preferably a check valve which permits charges of pressurized fuel to flow from fuel pump 4 to first end 8' of cavity 8. Naturally, valve 14 prevents the flow of fuel from cavity 8 back into fuel pump 4.

Fuel pump 4 is preferably a variable displacement high-pressure pump. When fuel is transferred into first end 8' of cavity 8 and the fuel-pressure builds to a sufficiently high level, the fuel-pressure urges various internal elements, described hereafter, of shuttle valve 20 rightwardly until a resilient compression spring 18 is compressed (See FIG. 2).

Shuttle valve 20 is preferably comprised of a shuttle body 21, a first fuel passage 22 with an associated annular portion 23, a second fuel passage 24 with an associated annular portion 25 at one end thereof and a shuttle-response passage 26 extending between first and second fuel passages 22 and 24, respectively. Finally, bore 27 extends through shuttle body 21 to enhance fluid communication between second fuel passage 24 and cavity 8.

As shown in FIG. 1, shuttle 20 is in a fuel-spill position wherein shuttle body 21 has been urged leftwardly by compression spring 18. In this fuel-spill position, second fuel passage 24 is in fluid communication with all of spill port 7, second end 8" of cavity 8, shuttle-response passage 26 and common rail 10. Thus, in this fuel-spill condition, excess fuel from common rail 10 is permitted to flow from common rail 10 through cavity 8, spill port 7, a second valve 19 and into an excess fuel receptacle (not shown) fluidly connected to second valve 19. This fuel-spill condition is the "default" condition in that biasing member 18 urges shuttle body 21 into this fuel-spill position in the absence of any other substantial influences on shuttle body.

Figure 2:
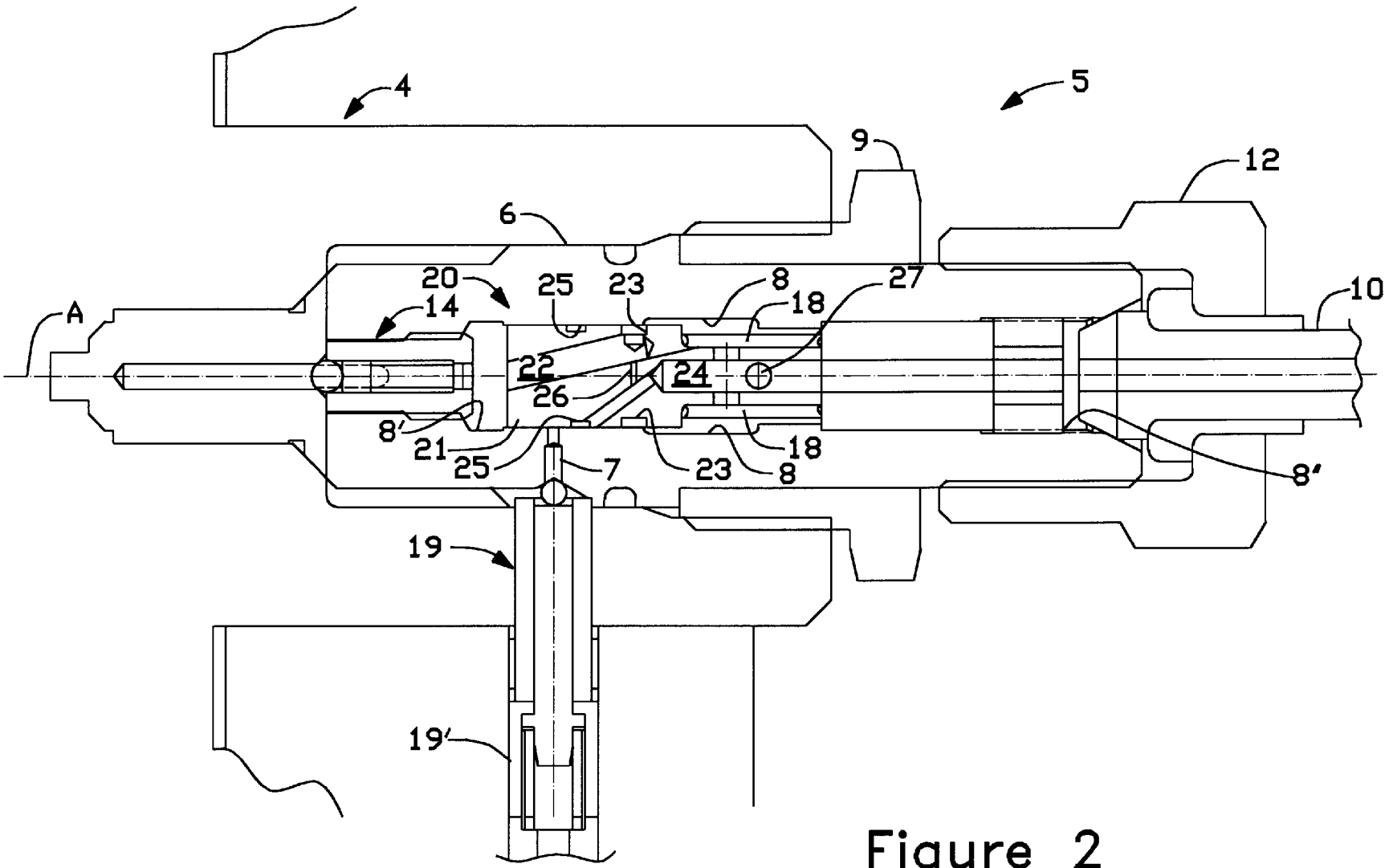
FIG. 2 is a cross-sectional view of the inventive pressure-reduction valve assembly in combination with a fuel pump and a fuel utilization device, the inventive valve assembly being shown in a fuel-transfer position.

It will be appreciated that the condition shown in FIG. 1 occurs when the output of fuel pump 4 drops after having previously urged shuttle body 21 rightwardly to the position shown in FIG. 2. During a first portion of the shuttle body's traversal from the FIG. 2 position to the FIG. 1 position, the bias-pressure of the fuel from first end 8' of cavity 8 is in equilibrium with that of the fuel from the common rail, because the common rail and first end 8' are in fluid communication with one another via annular portion 23. Under these conditions, shuttle body 21 is urged leftwardly solely by spring, or biasing member, 18. Once annular portion 23 is no longer in fluid communication with the common rail, however, the fuel from first end 8' of cavity 8 leaks through shuttle-response passage 26 at a rate which permits shuttle body 21 to move toward its leftward most position (FIG. 1) in about 0.1 seconds. Thus, at normal speeds, shuttle body 21 is effectively pinned in its rightward position by the repeated transfer of fuel charges into cavity 8. Fuel is, therefore, permitted free passage all the way from fuel pump 4 to common rail 10 under such conditions.

At low cranking speeds, the transfer of fuel charges into cavity 8 occurs at intervals greater than the 0.1 seconds which it takes for shuttle body 21 to move leftwardly and the above-described fuel-spill can occur. A minimum fuel-pressure is maintained in the common rail by placing second valve 19 downstream of spill port 7. Second valve 19 is preferably a check valve which is pre-biased by a bias mechanism 19' to maintain a minimum fuel-pressure within the fuel-supply system of a predetermined level, preferably 200 to 600 bar. Those of ordinary skill will, thus, appreciate that a number of well known styles of regulating valves can be used as valve 19.

Shuttle-response passage 26 is disposed between first and second passages 22 and 24 and its size and orientation controls the rate at which shuttle body 21 returns to its leftward most position. Preferably, the rate of fuel-flow through shuttle-response passage 26 is substantially lower than that of the fuel flowing through either of first or second fuel passages 22 and 24, respectively. It is also contemplated that shuttle-response passage 26 could be eliminated by designing and/or machining the various components of assembly 5 to permit limited leakage between first and second passages 22 and 24 and/or between shuttle body 21 and housing 6. It should be appreciated that passage 26 and/or the above-described leakage serves the purpose of preventing the fuel-pressure in first end 8' of the cavity from permanently trapping shuttle body 21 in its rightward most position due to creation of a hydraulic lock within first end 8' in the absence of passage 26.

As described above, the inventive pressure-reduction valve assembly operates on a hydro-mechanical principal and, therefore, obviates the need to rely on expensive electronic control systems in order to achieve the same or similar results. This design can, thus, achieve results comparable to much more expensive systems at a much lower cost. The inventive pressure-reduction valve assembly described herein is, therefore, advantageous relative to systems of the related art described above. Finally, those of ordinary skill will appreciate that the device of the present invention can be implemented as a device which is disposed in the fuel line downstream of the fuel pump rather than as an additional component of the fuel pump.

While the present invention has been described in connection with what is presently considered to be the most practical and preferred embodiment, it is to be understood that the invention is not limited to the disclosed embodiment, but is intended to cover the various modifications and equivalent arrangements included within the spirit and scope of the appended claims.

What is claimed is:

1. A hydro-mechanical device for receiving fuel from a high-pressure fuel pump of a fuel-supply system and delivering the fuel to a fuel utilization component of the fuel-supply system, whereby said device regulates the fuel-pressure in the fuel-supply system at least in part based on the output of the high-pressure pump, said device comprising:

a housing which defines an interior cavity having first and second ends and a spill port, said housing being affixed to the fuel pump such that said first end of said cavity is capable of receiving pressurized output fuel from the fuel pump and being affixed to the fuel utilization component such that said second end of said cavity is in fluid communication with the fuel utilization component;

a shuttle valve for regulating fuel-flow through said device, said shuttle valve being capable of movement between a fuel-transfer position, wherein the fuel utilization component is capable of receiving fuel from the fuel pump, and a fuel-spill position wherein said fuel utilization component is capable of delivering fuel to said spill port, said shuttle valve being disposed within said housing cavity intermediate said first and second ends thereof; and biasing means for resiliently biasing said shuttle valve toward said fuel-spill position.

2. The device of claim 1, wherein said device further comprises a first valve disposed within said housing cavity for limiting fuel-flow between the fuel pump and said cavity.

3. The device of claim 1, wherein the fuel-supply system includes a fuel overflow receptacle, said spill port is capable of delivering fuel from said device into the fuel overflow receptacle, and said device further comprises a second valve for limiting fuel-flow through said spill port.

4. The device of claim 1, wherein said shuttle valve comprises a shuttle body which defines first and second fuel passages, said first passage capable of being in fluid communication with said fuel pump and said second fuel passage being in fluid communication with said fuel utilization device.

5. The device of claim 4, wherein said shuttle body further defines a shuttle-response passage fluidly connecting said first and second fuel passages, said shuttle-response passage permitting restricted fuel-flow between said first and second fuel passages whereby said biasing means moves said shuttle body toward said fuel-spill position upon sufficient fuel-flow through said shuttle-response passage.

6. The device of claim 4, wherein said first fuel passage is also in fluid communication with said fuel utilization device when said shuttle is in said fuel-transfer position.

7. The device of claim 2, wherein said first valve is a check valve which prevents fuel from flowing from said device into the high-pressure fuel pump.

8. The device of claim 3, wherein said second valve is a regulating valve which limits fuel from flowing from said device through said spill port.

9. The device of claim 4, wherein said shuttle body is generally cylindrical, defines a longitudinal axis and is capable of linear reciprocal movement along said longitudinal axis, said first passage includes a generally annular trough disposed symmetrically about said axis, and said second passage includes a generally annular trough disposed symmetrically about said axis.

10. A hydro-mechanical device for regulating the fuel-pressure in a fuel-supply system employing a variable displacement fuel pump with an outlet for supplying high-pressure fuel to a common rail, said device comprising:

a housing which defines an interior cavity through which fuel may flow, said cavity having a first end which is fluidly connectable to the fuel pump and a second end which is fluidly connected to the common rail;

a shuttle valve for regulating fuel-flow through said interior cavity, said shuttle valve being capable of movement between a fuel-transfer position, wherein fuel may flow from the fuel pump, through said shuttle valve and into the common rail, and a fuel-spill position wherein fuel may flow from the common rail through said shuttle valve and out of said device; and a spring bias member resiliently biasing said shuttle valve toward said fuel-spill position.

11. The device of claim 10, further comprising a first valve for preventing fuel-flow from said first end of said cavity to the outlet of the fuel pump.

12. The device of claim 10, further comprising a second valve for limiting fuel-flow out of said device when said shuttle valve is in said fuel-spill position.

13. The device of claim 10, wherein said shuttle valve comprises a shuttle body which defines first and second fuel passages, said first passage capable of being in fluid communication with said fuel pump and said second fuel passage being in fluid communication with said common rail.

14. The device of claim 13, wherein said shuttle body further defines a shuttle-response passage fluidly connecting said first and second fuel passages, said shuttle-response passage permitting restricted fuel-flow between said first and second fuel passages whereby said spring bias member moves said shuttle body toward said fuel-spill position as fuel flows between said first and second fuel passages.

15. The device of claim 13, wherein said first fuel passage is also in fluid communication with said common rail when said shuttle is in said fuel-transfer position.

16. The device of claim 12, wherein said first valve is a check valve which prevents fuel from flowing from said device into the fuel pump.

17. The device of claim 11, wherein said second valve is a check valve which limits fuel flowing from said device through said spill port.

18. The device of claim 11, wherein said shuttle body is generally cylindrical, defines a longitudinal axis and is capable of linear reciprocal movement along said longitudinal axis, said first passage includes a generally annular trough disposed symmetrically about said axis, and said second passage includes a generally annular trough disposed symmetrically about said axis.

19. A method of regulating the fuel-pressure within a fuel-supply system of the type having a variable displacement pump, a common rail and a pressure-reduction valve assembly interposed between the pump and the common rail, said method comprising the steps of:

(a) creating a variable bias-pressure force within the pressure-reduction valve assembly;

(b) constantly providing a counter-force within the pressure-reduction valve assembly, said counter-force opposing said bias-pressure force;

(c) selectively spilling fuel discharged from the pump into the pressure-reduction valve assembly to thereby selectively and gradually reduce the bias-pressure force within the pressure-reduction valve assembly;

(d) passing fuel from the pressure-reduction valve assembly to the common rail when the bias-pressure force within the pressure-reduction valve assembly exceeds the counter-force and the force of the fuel-pressure within the common rail;

(e) selectively transferring fuel from the common rail into the pressure-reduction valve assembly;

(f) selectively spilling the fuel transferred from the common rail into the pressure-reduction valve assembly; and (g) repeating steps (a) through (f) whereby the fuel-pressure within the fuel-supply system is varied and/or maintained as desired.

20. The method of claim 19, wherein said step of creating a variable bias pressure force comprises alternately (1) discharging fuel from the pump into the pressure-reduction valve assembly for an unpredetermined period of time, and (2) ceasing the discharge of fuel from the pump into the pressure-reduction valve assembly for an unpredetermined period of time.

21. The method of claim 19, further comprising the steps of:

preventing fuel from being transferred from the pressure-reduction valve assembly to the fuel pump; and preventing said fuel spilling of steps (c) and (f) if the fuel-pressure of the fuel transferred into the pressure-reduction valve assembly is below a predetermined minimum value.

22. The method of claim 19, wherein the rate at which fuel is spilled in step (c) is substantially lower than the rate at which fuel is spilled in step (f).

23. A hydro-mechanical device for regulating the fuel-pressure in a fuel-supply system employing a common rail and a variable displacement fuel pump with an outlet for supplying fuel, said device comprising:

a housing which defines an interior cavity through which fuel may flow, said cavity having a first port which is fluidly connectable to the fuel pump and a second port which is fluidly connected to the common rail; and regulating means disposed within said interior cavity for passively regulating fuel-flow therethrough, said regulating means including means for providing a biasing force and means for spilling fuel from the device via a third port fluidly communicating with the interior cavity separate from the first port and the second port when the force provided by said means for biasing exceeds the force of the fuel-pressure within said cavity first end, said regulating means also including means for transferring fuel from the fuel pump to the common rail when the force of the fuel-pressure within said cavity first end exceeds the combined force of the fuel-pressure within the common rail and said means for biasing.

24. The device of claim 1 wherein said shuttle valve comprises a shuttle body having opposed ends and a side wall therebetween and said shuttle body defining first and second fuel passages, said first fuel passage capable of being in fluid communication with said fuel pump and said second fuel passage being in fluid communication with said fuel utilization component, said first fuel passage extending between one end of said shuttle body and said side wall and said second fuel passage extending between another of said ends of said shuttle body and said side wall and each of said first and second fuel passages extending at an angle to a longitudinal axis of the shuttle body which is greater than zero but less than 90 degrees.

* * * * *